US007473147B2

(12) United States Patent
Zahnen

(10) Patent No.: US 7,473,147 B2
(45) Date of Patent: Jan. 6, 2009

(54) TRANSFORMER STUD CONNECTOR WITH OFFSET KEEPER HOLDERS AND ASSOCIATED METHODS

(75) Inventor: James L. Zahnen, Ormond Beach, FL (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/944,888

(22) Filed: Nov. 26, 2007

(65) Prior Publication Data

US 2008/0076306 A1 Mar. 27, 2008

Related U.S. Application Data

(63) Continuation of application No. 11/368,777, filed on Mar. 6, 2006, now Pat. No. 7,311,564.

(51) Int. Cl.
*H01R 11/11* (2006.01)

(52) U.S. Cl. ..... 439/798

(58) Field of Classification Search ..... 439/798
See application file for complete search history.

(56) References Cited

U.S. PATENT DOCUMENTS

| | | | | |
|---|---|---|---|---|
| D309,664 | S | 7/1990 | McGrane | D13/146 |
| D320,381 | S | 10/1991 | McGrane | D13/147 |
| 5,931,708 | A | 8/1999 | Annas et al. | 439/798 |
| 6,579,131 | B1 | 6/2003 | Ashcraft et al. | 439/798 |
| 6,612,879 | B1 | 9/2003 | Zahnen | 439/798 |
| 6,971,926 | B1 | 12/2005 | Walton | 439/798 |
| 7,014,514 | B2 | 3/2006 | Zahnen | 439/798 |
| 7,320,626 | B2 * | 1/2008 | Drane et al. | 439/798 |
| 2002/0094729 | A1 | 7/2002 | Triantopoulos et al. | 439/798 |
| 2004/0067697 | A1 | 4/2004 | Zahnen | 439/798 |
| 2004/0087220 | A1 | 5/2004 | Norden | 439/798 |
| 2005/0287876 | A1 | 12/2005 | Drane et al. | 439/798 |

* cited by examiner

*Primary Examiner*—Gary F. Paumen
(74) *Attorney, Agent, or Firm*—Allen, Dyer, Doppelt, Milbrath & Gilcrist, P.A.

(57) ABSTRACT

An electrical connector for connecting a plurality of electrical conductors to a transformer stud. The electrical connector may include an electrically conductive body having a first and second generally rectangular portions connected in an offset arrangement. The first generally rectangular portion may have a transformer stud receiving passageway for receiving a transformer stud. The first and second generally rectangular portions may have respective first and second openings to define first and second keeper holders. Keepers are removably received in the keeper holders to secure electrical conductors therein.

31 Claims, 7 Drawing Sheets

TRANSFORMER STUD CONNECTOR WITH OFFSET KEEPER HOLDERS AND ASSOCIATED METHODS

FIELD OF THE INVENTION

The present application is a continuation of U.S. patent application Ser. No. 11/368,777 filed Mar. 6, 2006 , now U.S. Pat. No. 7,311,564 the entire content of which is incorporated herein by reference.

BACKGROUND OF THE INVENTION

In electrical power distribution systems, electrical conductors or cables are generally connected to a transformer conductor via an electrical connector. A transformer may include an output conductor in the form of a threaded stud that, in turn, is connected to a plurality of individual electrical conductors by a transformer stud connector. A transformer stud connector may be connected to the threaded transformer stud using either a screwed on connection or a more convenient slip-fit connection. Unfortunately, the available space between adjacent transformer conductors, such as within a transformer cabinet or housing, may be limited. Accordingly, it may be difficult to install the electrical connectors in this confined space.

U.S. Published Patent Application No. 2004/0067697 to Zahnen, and assigned to the assignee of the present invention, discloses a body having a multi-size transformer stud receiving passageway extending longitudinally inward from one end for receiving a transformer stud. The body further includes a plurality of transverse conductor receiving passageways for receiving electrical conductors. A plurality of fastener receiving passageways are provided for receiving a plurality of fasteners to secure electrical conductors in the electrical conductor receiving passageways.

U.S. Pat. No. 6,612,879 to Zahnen, and also assigned to the assignee of the present invention, represents another such electrical connector including a generally rectangular flat base, the rectangular base having a first end with a number of fastener receiving passageways for connecting to a transformer blade conductor. The rectangular base further connects to electrical conductors through offset keeper holders extending outwardly from a medial portion and second end of the base. Keepers are received in the keeper holders. Fasteners extend through the keepers to secure the electrical conductors in the keeper holders. The keepers allow for easier positioning of the relatively large gauge electrical cables, as the keepers can be removed during this phase of installation. However, this electrical connector is for a transformer having a blade terminal and does not accommodate a transformer stud connection.

Accordingly, there is a need to develop more installer friendly and convenient connectors for transformer stud applications.

SUMMARY OF THE INVENTION

In view of the foregoing background, it is therefore an object of the present invention to provide an electrical connector and methods for more efficiently connecting a plurality of electrical conductors to a transformer stud conductor, such as in a confined space.

This and other objects, features, and advantages in accordance with the present invention are provided by an electrical connector comprising an electrically conductive body including a first and second generally rectangular portions connected in an offset arrangement. The first generally rectangular portion may have a transformer stud receiving passageway for receiving a transformer stud conductor. The first generally rectangular portion may have at least one first opening to define at least one first keeper holder, and a respective first keeper may be removably received therein to secure an electrical conductor. The second generally rectangular portion may have at least one second opening to define at least one second keeper holder, and a respective second keeper may be removably received therein to secure an electrical conductor.

In other words, the electrical connector may accommodate a transformer stud conductor while positioning the at least one first keeper holder and second keeper holder in an offset arrangement. The offset arrangement advantageously provides space for an installer to manipulate tools necessary to secure the fasteners to, in turn, secure the keepers in the respective keeper holders.

The at least one first keeper may have at least one first fastener receiving passageway therein. At least one first fastener may be received in the at least one first fastener receiving passageway. The at least one second keeper may have at least one second fastener receiving passageway therein. A second fastener may be received in the second fastener receiving passageway. In other embodiments, the first generally rectangular portion may have at least one first fastener receiving passageway therein, and a first fastener may be received in the first fastener receiving passageway. In other words, the fasteners for the first keeper holders may extend through either the keepers or through the first generally rectangular portion. The second generally rectangular portion may similarly have at least one second fastener receiving passageway therein and a respective second fastener may be received in each second fastener receiving passageway.

Each keeper holder may have a pair of opposing keeper receiving recesses therein to slidably receive a respective keeper. Further, at least one end stop may be associated with the opposing keeper receiving recesses to prevent the respective keepers from sliding outwardly therepast.

The transformer stud receiving passageway may extend inwardly from an end of the first generally rectangular portion. In addition, the first generally rectangular portion may have a stud fastener receiving passageway therein. A stud fastener may be received in the stud fastener receiving passageway.

The first and second generally rectangular portions of the electrically conductive body may be integrally formed as a monolithic unit in some embodiments. Further, the electrically conductive body, at least one first keeper, and at least one second keeper may comprise aluminum, for example. Yet further, the first and second generally rectangular portions may each have an elongate shape.

A method aspect of the present invention is for making an electrical connector for connecting a plurality of electrical conductors to a transformer stud conductor. The method may comprise forming an electrically conductive body to have a first and second generally rectangular portions connected in an offset arrangement, and forming a transformer stud receiving passageway within the first generally rectangular portion. The method may further include forming at least one first opening in the first generally rectangular portion to define at least one first keeper holder. The method may further include forming at least one second opening in the second generally rectangular portion to define at least one second keeper holder. The method may further include providing first and second keepers to be removably received in the keeper holders to secure electrical conductors therein.

DETAILED DESCRIPTION OF THE PREFERRED EMBODIMENTS

Figure 1:
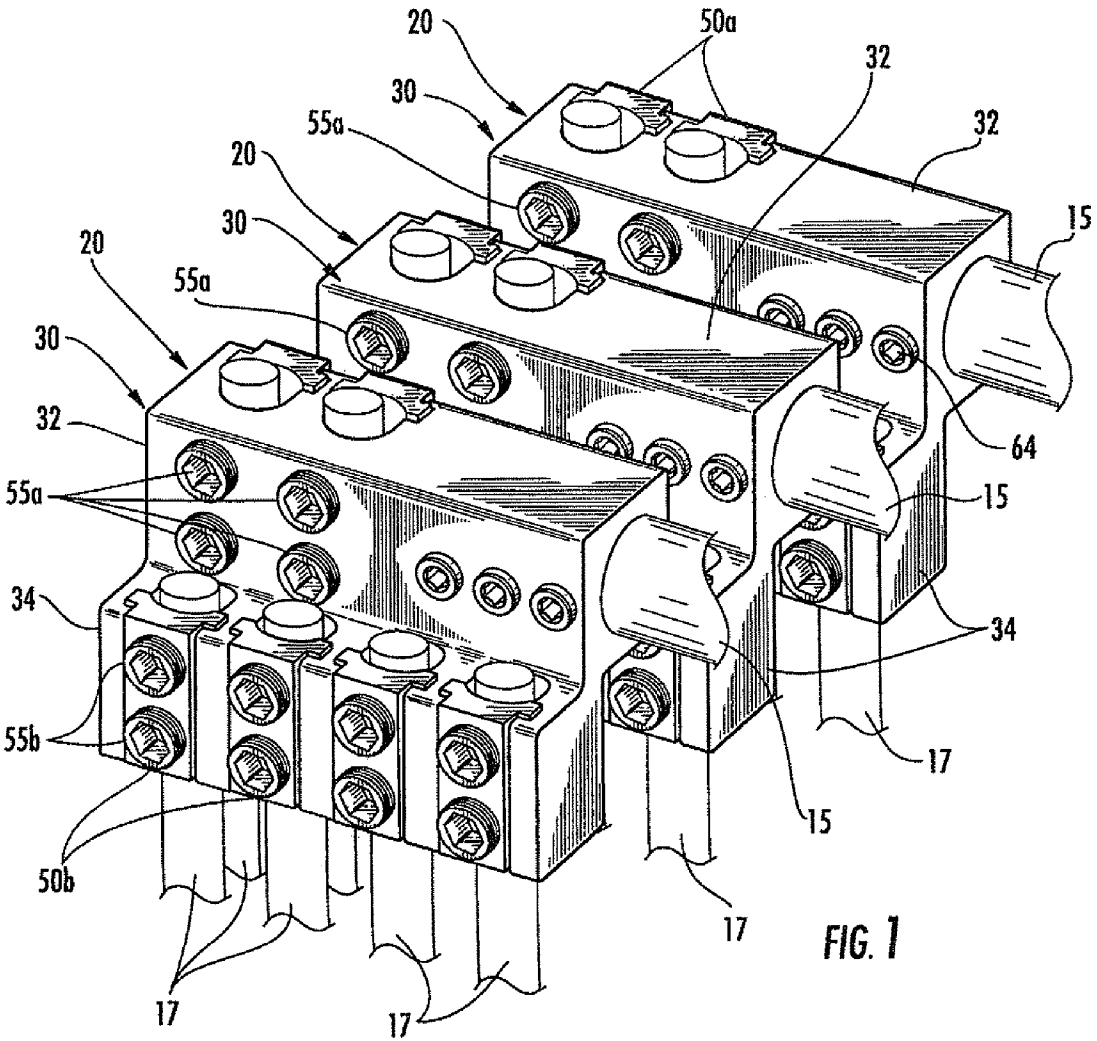
FIG. 1 is a perspective view of a plurality of electrical connectors connected to a plurality of transformer studs according to the present invention.
Figure 2:
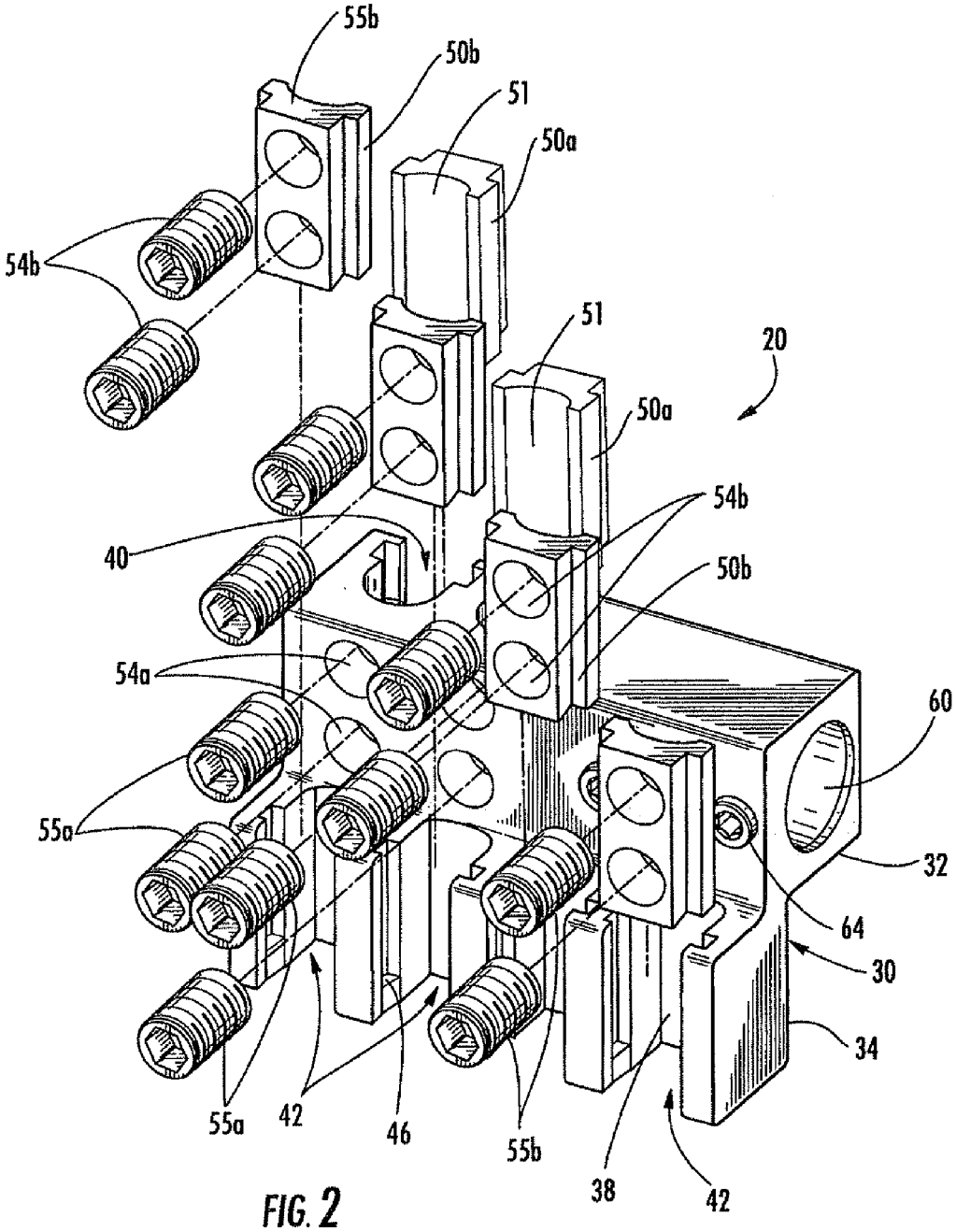
FIG. 2 is an exploded perspective view of one of the electrical connectors shown in FIG. 1.
Figure 3:
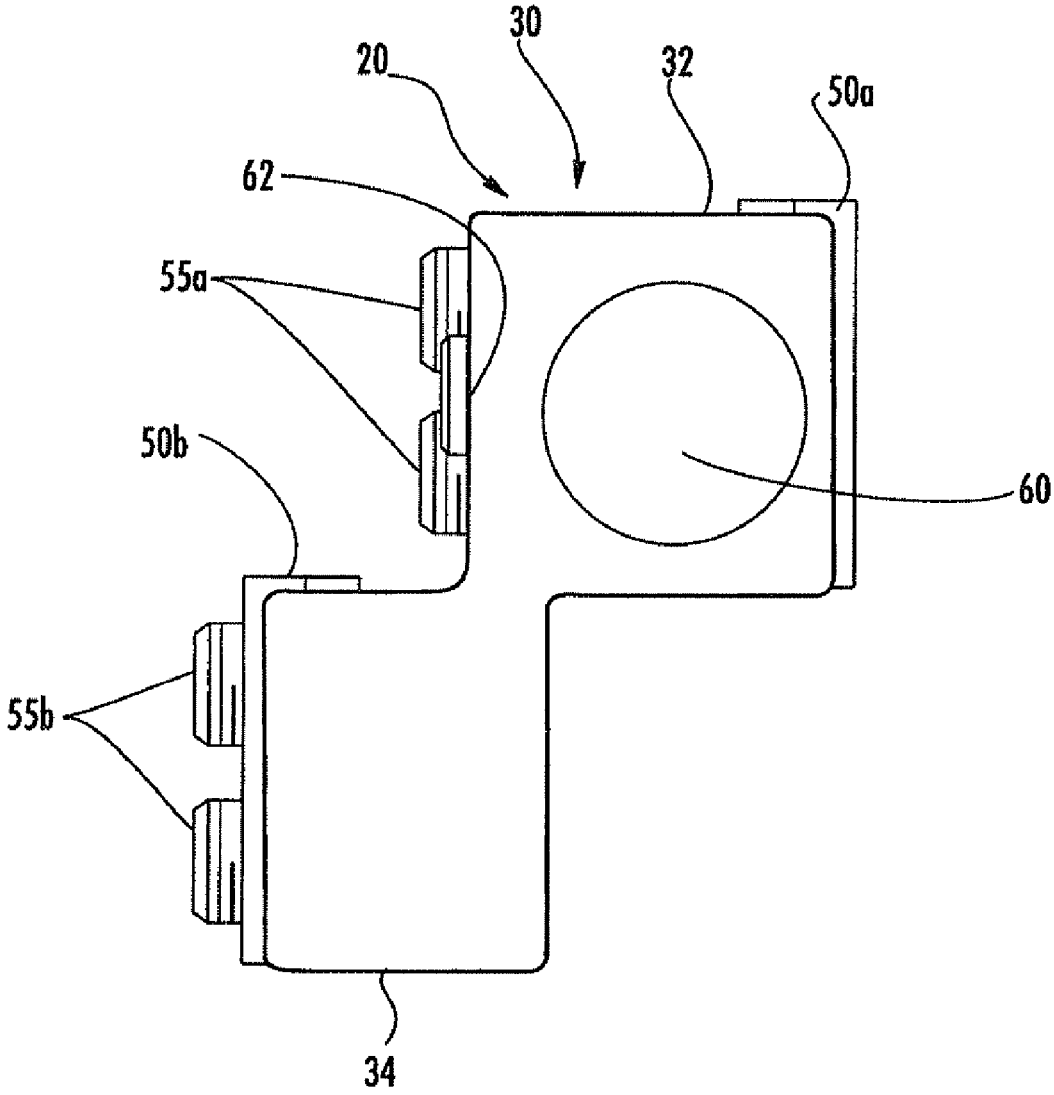
FIG. 3 is an end elevational view of the electrical connector shown in FIG. 2.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Referring initially to FIGS. 1-8, an electrical connector 20 for connecting a plurality of electrical conductors 17 to a transformer stud 15 is now described. The electrical connector 20 advantageously includes offset keeper holders 40, 42 to allow for more efficient connecting of the electrical conductors 17 to the transformer stud 15 in a confined space, such as within a cabinet, for example.

The electrical connector 20 illustratively includes an electrically conductive body 30 having first and second generally rectangular portions 32, 34 connected in an offset arrangement. The first generally rectangular portion 32 has a transformer stud receiving passageway 60 for receiving a transformer stud conductor 15. The transformer stud receiving passageway 60 may also be of a type that can accommodate different size transformer studs in a slip-fit fashion as disclosed in Published U.S. Patent Application No. 2004/0067697, the entire contents of which are incorporated herein by reference.

In the illustrated embodiment, a plurality of electrical connectors 20 are connected to respective transformer studs 15 in side-by-side relation. The conductive body 30 may, for example, comprise aluminum or any material having similar strength and electrical properties as understood by those skilled in the art.

The offset keeper holders include first keeper holders 40 and second keeper holders 42. More specifically, the first generally rectangular portion 32 has a plurality of first openings 36 to define first keeper holders 40. A first keeper 50*a* is removably received in each first keeper holder 40 to secure an electrical conductor 17 therein.

The second generally rectangular portion 34 has a plurality of second openings 38 to define second keeper holders 42. A second keeper 50*b* is removably received in each of the keeper holders 42 to secure an electrical conductor 17 therein. Although the illustrated connector 20 includes two first keeper holders 40 and four second keeper holders 42, as well as their associated keepers 50*a*, 50*b* those skilled in the art will appreciate that the electrical connector may include any number of keeper holders and associated keepers.

The first generally rectangular portion 32 has a pair of first fastener receiving passageways 54*a* and a pair of first fasteners 55*a* received in the first fastener receiving passageways. Each of the first fasteners 55*a* extends through a first fastener receiving passageway 54*a* to urge the conductor 17 outwardly against the first keeper 50*a* as will be appreciated by those skilled in the art. Each of the first keepers 50*a* illustratively includes an arcuate inner surface 51 directed towards the conductor 17 to accommodate the cylindrical shape of the conductor. Each of the second keepers 50*b* may similarly include such an arcuate inner surface. Although a pair of first fasteners 55*a* are illustratively received in the pair of first fastener receiving passageways 54*a* one or more than two fasteners and fastener receiving passageways can be used.

Each of the second keepers 42 has a pair of second fastener receiving passageways 54*b* therein and a pair of second fasteners 55*b* in the second fastener receiving passageways. Each of the second fasteners 55*b* extends through second fastener receiving passageways 54*b* to secure the conductor 17 within the second keeper holder 42.

Figure 4:
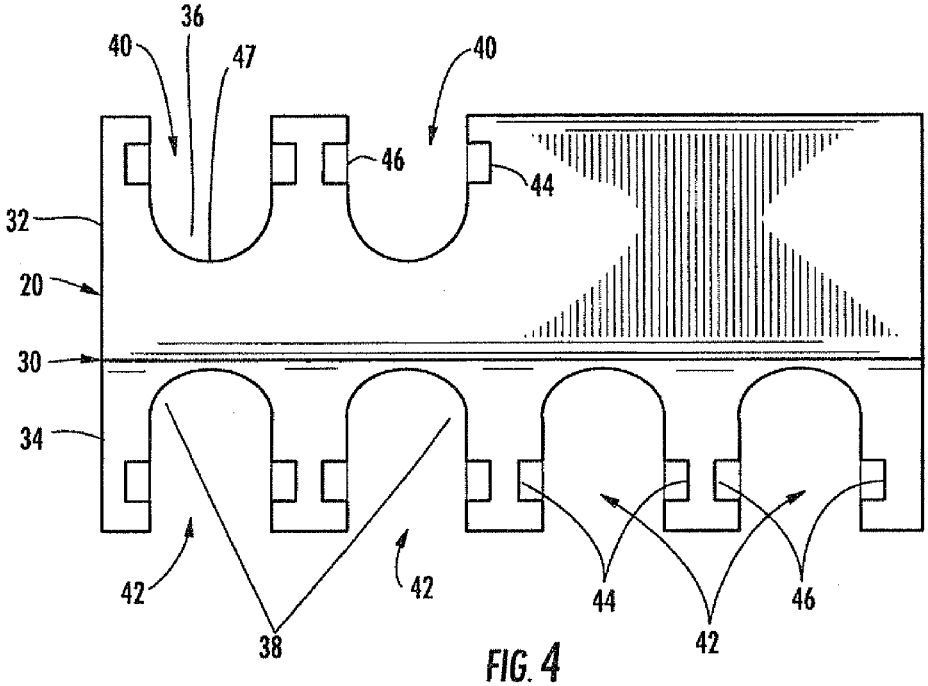
FIG. 4 is a bottom plan view of the electrical connector shown in FIG. 2.
Figure 5:
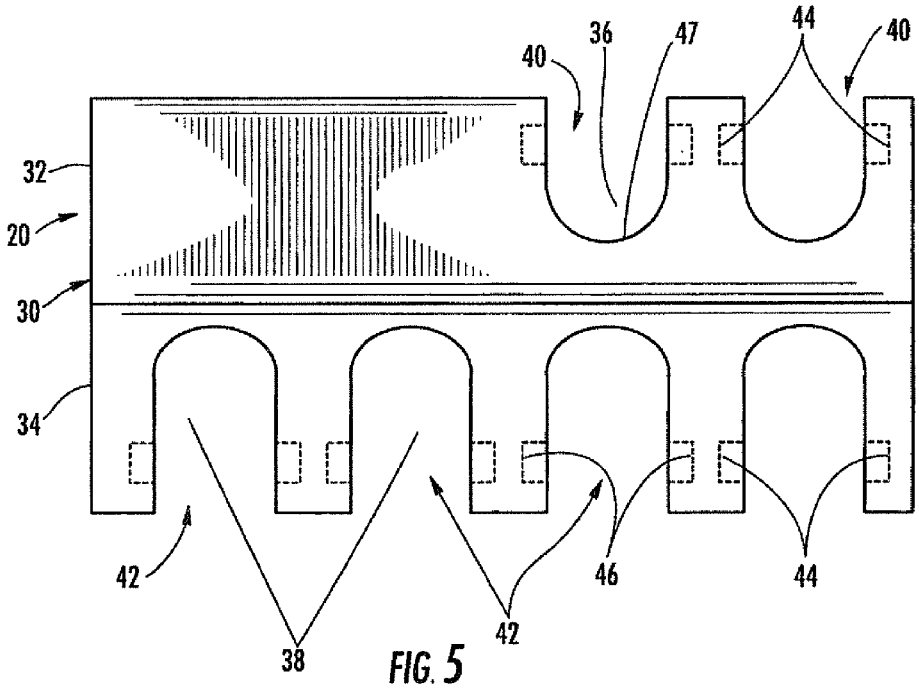
FIG. 5 is a top plan view of the electrical connector shown in FIG. 2.
Figure 6:
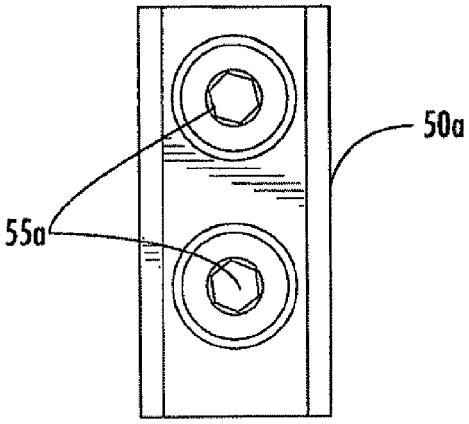
FIG. 6 is a front elevational view of a keeper of the electrical connector shown in FIG. 2.
Figure 7:
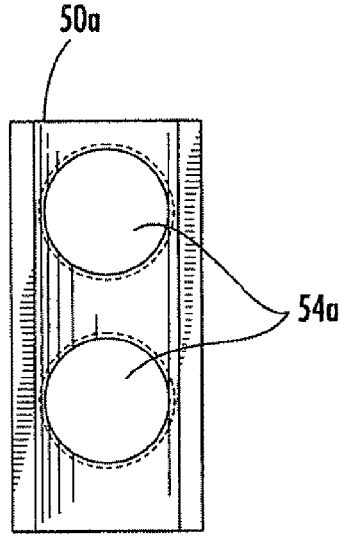
FIG. 7 is a rear elevational view of the keeper shown in FIG. 6 with the fasteners removed for clarity.
Figure 8:
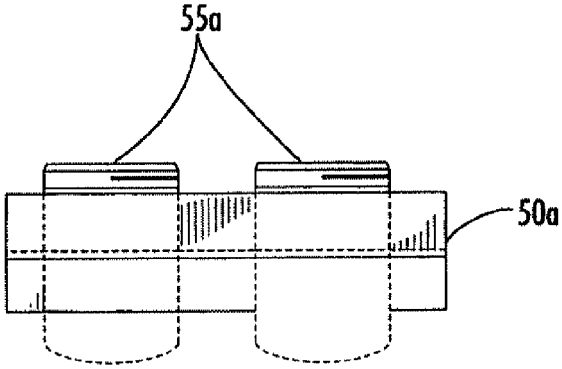
FIG. 8 is a side elevational view of the keeper shown in FIG. 7.

The first keeper holders 40 and second keeper holders 42 each includes a pair of opposing keeper receiving recesses 44 therein to slidably receive a respective keeper 50*a*, 50*b*, as shown perhaps best in FIGS. 4 and 5. The keeper holders 40, 42 also each illustratively include a pair of end stops 46 associated with the keeper receiving recesses 44 to prevent the respective keepers 50*a*, 50*b* from sliding outwardly therepast.

The first rectangular portion 30 illustratively has a transformer stud receiving passageway 60 that extends inwardly from an end thereof. One or more stud fastener receiving passageways 62 are illustratively provided formed in the first rectangular portion 30 and intersect the transformer stud receiving passageway 60. A stud fastener 64 is illustratively positioned in each stud fastener receiving passageway 62 for fastening the transformer stud 15 in the transformer stud receiving passageway 60. As appreciated by one of skill in the art, any number of stud fastener receiving passageways 62 and stud fasteners 64 may be used in fastening transformer stud 15 within the passageway 60.

The first and second rectangular portions 30, 32 of the electrically conductive body 30 may be integrally formed as a monolithic unit. The electrically conductive body 30, the first keeper 50*a* and second keeper 50*b* may comprise aluminum, for example, or another material having similar strength and electrical properties as understood by those skilled in the art. The first and second generally rectangular portions 32, 34 may have an elongate shape, for example.

Figure 9:
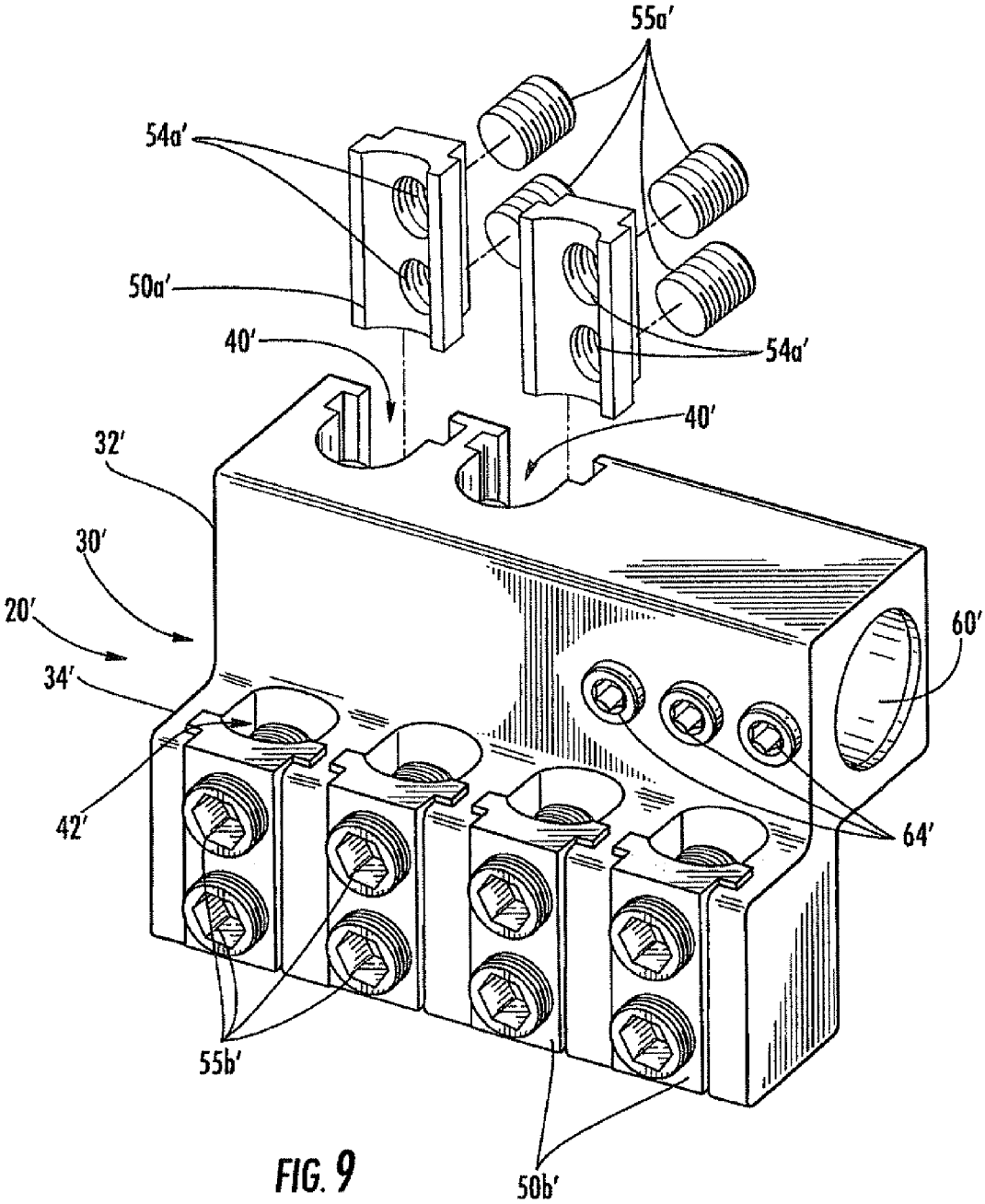
FIG. 9 is an exploded perspective view of another embodiment of the electrical connector according to the present invention.
Figure 10:
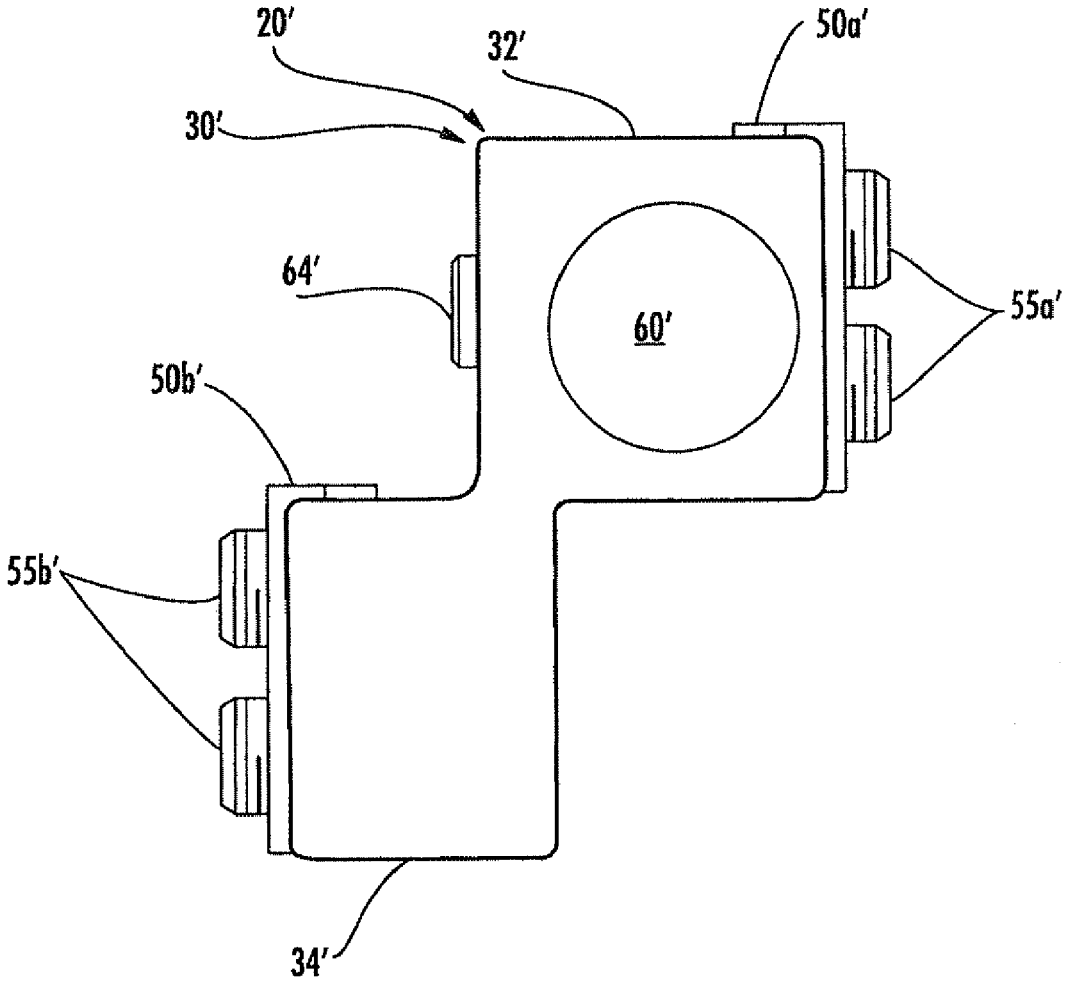
FIG. 10 is an end elevational view of the electrical connector shown in FIG. 9.

Turning now more specifically to FIGS. 9-10, a second embodiment of the electrical connector 20' is now described. In the second embodiment of the electrical connector 20', each first keeper 50*a*' has a pair of first fastener receiving passageways 54*a*' therein, and a pair of first fasteners 55*a*, therein. Those other elements, not specifically mentioned, are indicated with prime notation, are similar to those elements described above, and need no further discussion herein.

Referring again to FIGS. 1-8, a method aspect of the present invention is for making an electrical connector 20 for connecting a plurality of electrical conductors 17 to a transformer stud 15. The method may include forming an electrically conductive body 30 to have first and second generally rectangular portions 32, 34 connected in an offset arrangement. The method may also include forming a transformer stud receiving passageway 60 within the first generally rectangular portion 32. The method may further include forming one or more first openings 36 in the first generally rectangular portion 32 to define one or more first keeper holders 40. The method may also include forming one or more second openings 38 in the second generally rectangular portion 34 to define one or more second keeper holders 42. The method may further include providing a first keeper 50*a* and second keeper 50*b* to be removably received in each first keeper holder 40 and second keeper holder 42, respectively, to secure at least one electrical conductor therein.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An electrical connector for connecting a plurality of electrical conductors to a transformer stud, the electrical connector comprising:

an electrically conductive body comprising first and second portions connected in an offset arrangement;

said first portion having at least one first opening therein to define at least one first keeper holder;

said second portion having at least one second opening therein to define at least one second keeper holder;

at least one first keeper removably received in said at least one first keeper holder to secure at least one electrical conductor therein; and at least one second keeper removably received in said at least one second keeper holder to secure at least one electrical conductor therein;

said first portion having a transformer stud receiving passageway therein.

2. The electrical connector according to claim 1 wherein said at least one first keeper has at least one first fastener receiving passageway therein; and further comprising at least one first fastener in the at least one first fastener receiving passageway.

3. The electrical connector according to claim 1 wherein said at least one second keeper has at least one second fastener receiving passageway therein; and further comprising at least one second fastener in the at least one second fastener receiving passageway.

4. The electrical connector according to claim 1 wherein said first portion has at least one first fastener receiving passageway therein; and further comprising at least one first fastener in the at least one first fastener receiving passageway.

5. The electrical connector according to claim 1 wherein said second portion has at least one second fastener receiving passageway therein; and further comprising at least one second fastener in the at least one second fastener receiving passageway.

6. The electrical connector according to claim 1 wherein each keeper holder has a pair of opposing keeper receiving recesses therein to slidably receive a respective keeper.

7. The electrical connector according to claim 6 wherein each keeper holder further comprises an end stop associated with the opposing keeper receiving recesses to prevent the respective keeper from sliding outwardly therepast.

8. The electrical connector according to claim 1 wherein the transformer stud receiving passageway extends inwardly from an end of said first portion.

9. The electrical connector according to claim 1 wherein said first portion has at least one stud fastener receiving passageway therein; and further comprising at least one stud fastener in the at least one stud fastener receiving passageway.

10. The electrical connector according to claim 1 wherein said first and second portions of said electrically conductive body are integrally formed as a monolithic unit.

11. The electrical connector according to claim 9 wherein said electrically conductive body, said at least one first keeper, and said at least one second keeper each comprises aluminum.

12. The electrical connector according to claim 1 wherein each of said first and second portions has an elongate shape.

13. An electrical connector for connecting a plurality of electrical conductors to a transformer stud, the electrical connector comprising:

an electrically conductive body comprising first and second elongate portions connected in an offset arrangement;

said first elongate portion having a plurality of first openings therein to define a plurality of first keeper holders;

said second elongate portion having a plurality of second opening therein to define a plurality of second keeper holders;

a respective first keeper removably received in each of said plurality of first keeper holders to secure electrical conductors therein; and a respective second keeper removably received in each of said plurality of second keeper holders to secure electrical conductors therein;

said first elongate portion having a transformer stud receiving passageway extending inwardly from an end thereof.

14. The electrical connector according to claim 13 wherein each of said first keepers has at least one first fastener receiving passageway therein; and further comprising at least one first fastener in the at least one first fastener receiving passageway.

15. The electrical connector according to claim 13 wherein each of said second keepers has at least one second fastener receiving passageway therein; and further comprising at least one second fastener in the at least one second fastener receiving passageway.

16. The electrical connector according to claim 13 wherein said first elongate portion has a plurality of first fastener receiving passageways therein; and further comprising a respective first fastener in each of said plurality of first fastener receiving passageways.

17. The electrical connector according to claim 13 wherein said second elongate portion has a plurality of second fastener receiving passageways therein; and further comprising a respective second fastener in each of said plurality of second fastener receiving passageways.

18. The electrical connector according to claim 13 wherein each of said plurality of keeper holders has a pair of opposing keeper receiving recesses therein to slidably receive a respective keeper; and wherein each of said plurality of keeper holders further comprises an end stop associated with the opposing keeper receiving recesses to prevent the respective keeper from sliding outwardly therepast.

19. The electrical connector according to claim 18 wherein said first elongate portion has a plurality of stud fastener receiving passageways therein; and further comprising a respective stud fastener in each of said plurality of stud fastener receiving passageways.

20. A method for making an electrical connector for connecting a plurality of electrical conductors to a transformer stud, the method comprising:

forming an electrically conductive body to have a first and second portions connected in an offset arrangement;

forming a transformer stud receiving passageway within the first portion;

forming at least one first opening in the first portion to define at least one first keeper holder;

forming at least one second opening in the second portion to define at least one second keeper holder;

providing at least one first keeper to be removably received in the at least one first keeper holder to secure at least one electrical conductor therein; and providing at least one second keeper to be removably received in the at least one second keeper holder to secure at least one electrical conductor therein.

21. A method according to claim 20 further comprising:

forming at least one first fastener receiving passageway in the at least one first keeper; and positioning at least one first fastener in the at least one first fastener receiving passageway.

22. A method according to claim 20 further comprising:

forming at least one second fastener receiving passageway in the at least one second keeper; and positioning at least one second fastener in the at least one second fastener receiving passageway.

23. A method according to claim 20 further comprising:

forming at least one first fastener receiving passageway in the first portion; and positioning at least one first fastener in the at least one first fastener receiving passageway.

24. A method according to claim 20 further comprising:

forming at least one second fastener receiving passageway in the second portion; and positioning at least one second fastener in the at least one second fastener receiving passageway.

25. A method according to claim 20 further comprising forming a pair of opposing keeper receiving recesses in each keeper holder.

26. A method according to claim 25 wherein forming the keeper holders further comprises forming an end stop associated with the opposing keeper receiving recesses to prevent the respective keeper from sliding outwardly therepast.

27. A method according to claim 20 further comprising forming a transformer stud receiving passageway extending inwardly from an end of the first portion.

28. A method according to claim 20 further comprising:

forming at least one stud fastener receiving passageway in said first portion; and positioning at least one stud fastener in the at least one stud fastener receiving passageway.

29. A method according to claim 20 further comprising integrally forming said first and second portions of the electrically conductive body as a monolithic unit.

30. A method according to claim 28 further comprising forming the electrically conductive body, the at least one first keeper, and the at least one second keeper from an aluminum material.

31. A method according to claim 20 further comprising forming each of the first and second portions with an elongate shape.

* * * * *